US005188770A

United States Patent [19]

Pennewiss

[11] Patent Number: 5,188,770

[45] Date of Patent: Feb. 23, 1993

[54] VISCOSITY INDEX IMPROVER HAVING DETERGENT PROPERTIES

[75] Inventor: Horst Pennewiss, Darmstadt, Fed. Rep. of Germany

[73] Assignee: R hm GmbH, Darmstadt, Fed. Rep. of Germany

[21] Appl. No.: 576,670

[22] Filed: Aug. 31, 1990

[30] Foreign Application Priority Data

Sep. 9, 1989 [DE] Fed. Rep. of Germany ..... 3930142

[51] Int. Cl.[5] ..... C10M 157/00; C10M 145/14

[52] U.S. Cl. ..... 252/56 S; 252/56 R; 252/52 A; 44/393; 44/395; 44/397; 44/459

[58] Field of Search ..... 252/56 R, 56 S, 49.5

[56] References Cited

U.S. PATENT DOCUMENTS

| | | | |
|---|---|---|---|
| 3,001,942 | 9/1961 | Mulvany et al. | 252/56 |
| 3,198,739 | 8/1965 | Richards et al. | 252/56 |
| 3,377,285 | 4/1968 | Randles | 252/51.5 |
| 3,732,334 | 5/1973 | Koch et al. | 260/875 |
| 4,149,984 | 4/1979 | Wenzel et al. | 252/51.5 A |
| 4,229,311 | 10/1980 | Wenzel et al. | 252/50 |
| 4,281,081 | 7/1981 | Jost et al. | 525/281 |
| 4,290,925 | 9/1981 | Pennewiss et al. | 252/56 S |
| 4,338,418 | 7/1982 | Jost et al. | 525/281 |
| 4,622,358 | 11/1986 | Pennewiss et al. | 524/297 |
| 4,677,151 | 6/1987 | Pennewiss et al. | 524/501 |
| 4,822,508 | 4/1989 | Pennewiss et al. | 252/56 R |
| 4,867,894 | 9/1989 | Pennewiss et al. | 252/56 R |
| 4,968,444 | 11/1990 | Knoell et al. | 252/56 R |

FOREIGN PATENT DOCUMENTS

| | | |
|---|---|---|
| 0032175 | 7/1981 | European Pat. Off. . |
| 0014746 | 9/1983 | European Pat. Off. . |
| 1235491 | 3/1967 | Fed. Rep. of Germany . |
| 3613992 | 10/1987 | Fed. Rep. of Germany . |
| 1173356 | 10/1958 | France . |
| 0695527 | 1/1969 | South Africa . |
| 0822632 | 10/1959 | United Kingdom . |
| 0974473 | 11/1964 | United Kingdom . |
| 1068283 | 5/1967 | United Kingdom . |
| 1308924 | 6/1971 | United Kingdom . |
| 1246585 | 9/1971 | United Kingdom . |
| 1333733 | 10/1973 | United Kingdom . |
| 22003893 | 3/1979 | United Kingdom . |

OTHER PUBLICATIONS

Hughes et al., "Heterogeneous Polymer Systems", Journal of Applied Polymer Science, vol. (17), pp. 580–588 (1961).

Kirk-Othmer, Encyclopedia of Chemical Technology, 3rd Edition, vol. 18, pp. 734–736, John Wiley & Sons, New York (1982).

*Primary Examiner*—Ellen McAvoy

[57] ABSTRACT

Polyalkyl acrylates and methacrylates, suitable for improvement of the viscosity index, are used as oil additives imparting improved dispersant and detergent effects in diesel and gasoline engines, said polyalkyl acrylates or methacrylates being copolymers comprising from 80 to 99.5 parts by weight of alkyl acrylates of methacrylates of the formula

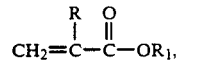

wherein R is hydrogen or methyl and $R_1$ is alkyl having from 6 to 24, and preferably from 8 to 20, carbon atoms, together with from 0.5 to 20 parts by weight of at least one functionalized alkyl methacrylate of the formula

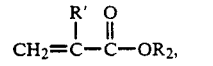

wherein $R^1$ is hydrogen or methyl and $R_2$ is alkyl having from 2 to 6 carbon atoms and substituted with at least one OH group, or is a polyalkoxylated group of the formula

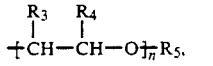

wherein $R_3$ and $R_4$ are hydrogen or methyl, $R_5$ is hydrogen or alkyl having from 1 to 40 carbon atoms, and n in an integer from 1 to 60, the sum of the monomers of formulas (I) and (II) being 100 parts by weight, and optionally further comprising from 0 to 20 parts by weight of one or more monomers of the formula

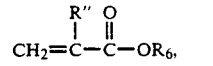

wherein R″ is hydrogen or methyl and $R_6$ is alkyl having from 1 to 5 carbon atoms. Such copolymers are conveniently prepared by copolymerization, advantageously in an oil-compatible vehicle in the presence of an olefin copolymer to form a concentrated emulsion additive.

17 Claims, No Drawings

VISCOSITY INDEX IMPROVER HAVING DETERGENT PROPERTIES

The present invention relates to viscosity-index (VI) improvers having good shear stability and good dispersant and detergent action in lubricating oils, particularly in oils for diesel engines and gasoline engines, and to methods for making the same. More in particular, said improvers are copolymers comprising a long-chain alkyl acrylate or methacrylate ester monomer and an acrylate or methacrylate ester monomer wherein the alcohol portion comprises hydroxy substituted alkyl or a polyalkoxylated residue. Such copolymers are conveniently made by copolymerization of said monomers in an oil compatible liquid vehicle, optionally in the presence of a further polymer or copolymer, to form an oil additive.

THE PRIOR ART

Modern high performance engines impose steadily more stringent requirements on the dispersant and detergent properties of engine lubricating oils.

So far as gasoline engines are concerned, tests performed in engines selected for this purpose (DB-M 102E or Sequence VE Test) are used to evaluate the sludge dispersing action. In diesel engines, the tendency to form sediments, which inter alia can result in sticking piston rings, is evaluated by means of the VW-TD or MWM-B engine test.

As a rule, the overall requirements can only be met with multigrade oils which in addition to appropriately coordinated detergent/inhibitor (DI) packages contain VI improvers having optimized dispersant/detergent properties.

It has long been known that specific dispersant action can be introduced into polymeric VI improvers through polar, and particularly through basic, comonomers, for example N-vinylheterocyclic compounds or dialkylaminoalkyl acrylates or methacrylates. (See, for example, H. Rauch-Puntigam and Th. Völker, *Acryl- und Methacrylverbindungen,* pp. 314–318, Springer-Verlag, Berlin, 1967; *Ullmanns Enzyklopadie der technischen Chemie,* 4th ed., vol. 20, pp. 547–550, Verlag Chemie, 1981.)

Of particular interest from the technical point of view is grafting onto olefin copolymers (OCP) and polyalkyl acrylate and methacrylate backbone polymers (PAMA) with monomers having dispersing action, for which various process variations have been proposed in the course of time. (See, for example, German patent publication 12 35 491, Belgian patent publication 592,880, or U.S. Pat. Nos. 4,281,081, 4,338,418 and 4,290,025.)

THE OBJECT OF THE INVENTION

Based on past experience, N-vinylpyrrolidone, in addition to N-vinylimidazole, is especially well suited for use as a monomer having dispersing action. In particular, grafted products with OCP or PAMA as backbone polymers, or as constituents of concentrated polymer emulsions composed of both polymer classes (so-called "mixed polymers"; see European patent 14,746), have gained practical importance. Concentrated emulsions of olefin copolymers with a graft or block copolymer of olefin copolymer sequences and polyacrylate or polymethacrylate sequences are described in European patent 88,904 as an emulsifier in a vehicle which does not substantially dissolve the olefin copolymers but does dissolve the polyacrylate or polymethacrylate sequences, the olefin copolymers being emulsified in the vehicle at from 40° C. to 150° C. with the application of shearing stress.

On the other hand, it has been found that in many cases adequate dispersant/detergent action can be achieved when the grafting yield in the grafting of N-vinylpyrrolidone is increased from about 60 percent to about 75 percent. While the grafting yield can obviously be improved by increasing the grafting component from about 58 percent to about 70 percent, based on the PAMA backbone polymer, this entails serious disadvantages so that this approach represents no real progress. For example, the molecular weight is disproportionately increased by crosslinking side reactions of the backbone chains (so-called grafting rise in molecular weight) in the grafting stage with N-vinylpyrrolidone, as a consequence of which the shear stability decreases sharply. The ratio of thickening action to shear stability then falls far short of satisfying the prevailing requirements.

Thus there has been a need to provide polyalkyl acrylates or methacrylates, especially in the form of highly concentrated polymer emulsions with adequate dispersing action and detergent action, whose other properties, and particularly the ratio of thickening action to shear stability, meet present day requirements. It has now been found that the additives in accordance with the present invention satisfy practical requirements to a high degree.

The invention relates to polyalkyl acrylates or methacrylates (PAMA) and to concentrated polymer emulsions thereof suitable with polyalkyl acrylates or methacrylates and olefin copolymers (OCP) in a liquid vehicle, suitable for improvement of the viscosity index, and to their use as oil additives with improved dispersant and detergent action in diesel and gasoline engines, the polyalkyl acrylates or methacrylates being composed of from 80 to 99.5 parts by weight of alkyl acrylates or methacrylates of the formula $$CH_2{=}\overset{\overset{\displaystyle R}{|}}{C}{-}\overset{\overset{\displaystyle O}{\|}}{C}{-}OR_1, \qquad \text{(I)}$$

wherein R is hydrogen or methyl and $R_1$ is alkyl group having from 6 to 24, and preferably from 8 to 20, carbon atoms, together with from 0.5 to 20 parts by weight of at least one functionalized alkyl methacrylate of the formula $$CH_2{=}\overset{\overset{\displaystyle R'}{|}}{C}{-}\overset{\overset{\displaystyle O}{\|}}{C}{-}OR^2, \qquad \text{(II)}$$

wherein R' is hydrogen or methyl and $R_2$ is alkyl having from 2 to 6 carbon atoms which is substituted with at least one OH group, or a polyalkoxylated group of the formula $$\left[\overset{\overset{\displaystyle R_3}{|}}{CH}{-}\overset{\overset{\displaystyle R_4}{|}}{CH}{-}O\right]_n R_5,$$

wherein $R_3$ and $R_4$ are hydrogen or methyl, $R_5$ is hydrogen or alkyl having from 1 to 40 carbon atoms, and n is an integer from 1 to 60, the sum of the monomers of formulas (I) and (II) being 100 parts by weight. The copolymer may additionally comprise from 0 to 20 preferably from 0.5 to 15 parts by weight of one or more comonomers of the formula

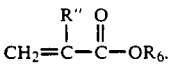

(III)

wherein R'' is hydrogen or methyl and $R_6$ is alkyl having from 1 to 5 carbon atoms.

In addition to the monomers of formulas (II) and (III), there may also be copolymerized from 0 to 20, and preferably from 0.5 to 15, parts by weight of a functionalized alkyl acrylate methacrylate of the formula

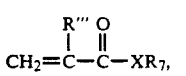

(IIA)

wherein X is oxygen or —NH or —$NR'_6$, R''' is hydrogen or methyl, and $R_7$ is linear or branched alkyl having from 2 to 20, and preferably from 2 to 6, carbon atoms which is substituted with at least one —$NR_8R_9$ group, $R_8$ and $R_9$ taken alone being, independently of each other, alkyl having from 1 to 20, and preferably from 1 to 6, carbon atoms, and $R_8$ and $R_9$ taken together form, with inclusion of the nitrogen atom and optionally of a further nitrogen or oxygen atom, a five- or six-membered ring, which optionally may be substituted with a $C_1$–$C_6$ alkyl, and where $R'_6$ has the same meaning as $R_6$, and/or a heterocyclic vinyl compound of the formula

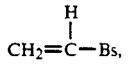

(IIB)

wherein Bs is a five- or six-membered heterocycle, and in particular a N-heterocycle, preferably from the group where Bs is pyridine, carbazole, imidazole or, in particular, pyrrolidone.

In one modification of the invention, the polymerization of the monomers of formulas (I), (II), (IIA), (IIB), and optionally (III), is followed by the addition and polymerization of another 0.5 to 15 parts by weight of monomers of the formula (IIA) and/or (IIB), optionally together with 1 to 30 parts by weight of monomers of formulas (I) and (III). In another modification of the invention, the polyacrylates or polymethacrylates are present in a liquid oil-compatible vehicle in combination with olefin copolymers (OCP) and/or hydrogenated isoprene- or butadiene-styrene copolymers (HSD) and/or hydrogenated polyisoprene or polybutadiene in the form of concentrated polymer emulsions.

The present invention further relates to a method for making concentrated polymer emulsions of polyacrylates or polymethacrylates and olefin copolymers, suitable for improving the viscosity index, in liquid vehicles for use as oil additives with improved dispersant and detergent action in diesel and gasoline engines. In this method, from 80 to 99.5 parts by weight of alkyl acrylates or methacrylates of the aforementioned formula (I) together with from 0.5 to 20 parts by weight of functionalized alkyl acrylates or methacrylates of the aforementioned formula (II) are polymerized, the sum of the monomers of formulas (I) and (II) being always 100 parts by weight, together with from 0 to 20 parts by weight of one or more monomers of the aforementioned formula (III) and from 0 to 20 parts by weight of one or more monomers of the aforementioned formulas (IIA) and/or (IIB), the substituents (R, R', R'', R''', X, $R_1$ to $R_9$, and Bs) having the meanings given above, in the presence of from 1 to 30 percent by weight (based on the total of the monomers and polymers present in the batch) of olefin copolymers (OCP}and/or hydrogenated isoprene or butadiene-styrene copolymers (HSD) and/or hydrogenated polyisoprene or polybutadiene.

In a modification of the process for the production of concentrated polymer emulsions, the polymerization of the monomers of formulas (I), (II), (IIA), (IIB), and (III) may be carried out with the addition of from 0.1 to 2.0 percent by weight of a free radical initiator and in the presence of from 0.05 to 0.5 percent by weight of a molecular-weight regulator, both based on the total monomers. The regulator may be a commonly used sulfur chain-transfer agent (see Th. Völker and H. Rauch-Puntigam, *Acryl- and Methacrylverbindungen*, Springer-Verlag, 1968), or such products as terpinolene and its derivatives.

The concentration of the monomers and polymers is preferably such that the total of the monomers and polymers present in the liquid vehicle is from 40 to 75, and preferably from 55 to 70, percent by weight of the overall system.

In another advantageous modification of the process, further olefin copolymer is added to the polymerization batch on completion of polymerization in such amounts that the olefin copolymer represents from 31 to 80 percent by weight of the total polymer. The olefin copolymer is advantageously added as is, that is, undiluted, preferably by being incorporated in the emulsion with shearing action.

Alternatively, the additional olefin copolymer may be added as a solution, for example as a 10 to 20 percent solution in a liquid vehicle.

As is apparent from the foregoing, VI improvers which are known per se, namely, olefin copolymers (OCP), polyalkyl acrylates and methacrylates (PAMA), and the aforesaid "mixed polymers" of European patent 14,746, for example, are used as backbone polymers in the process of the invention.

THE POLYALKYL ACRYLATES OR METHACRYLATES

The polyalkyl acrylates or methacrylates are mainly those having alkyl groups with from 6 to 24 carbon atoms, which groups provide solubility in petroleum oil. Shorter alkyl groups, and those with polar substituents, which do not provide solubility in petroleum oil, may be present up to a certain percentage. The weight-average molecular weight ranges from 5,000 to 1,000,000, and preferably from 50,000 to 500,000. Such products are described in British patent publication 1,068,283, in U.S. Pat. Nos. 3,732,334, 4,149,984, 4,229,311, 4,281,081, 4,338,418, and 4,290,925, in German patents 3,339,103, 3,607,444 and 3,613,992, and in U.S. Pat. Nos. 4,677,151, 4,622,358, and 4,822,508. The monomers to be used in the process of the invention will now be described in detail.

THE ALKYL ACRYLATES OR METHACRYLATES

The invention requires that alkyl acrylates or methacrylates of formula (I) be copolymerized in amounts of from 80 to 99.5, and preferably from 90 to 98.5, parts by weight. Illustrative of monomers of formula (I) are acrylic and methacrylic esters of tallow fatty alcohols (e.g. having 14 to 20 carbon atoms, on average about 17.3 carbon atoms), of coconut fatty alcohols (having 10 to 16 carbon atoms, on average about 12.6 carbon atoms), or of synthetic alcohols such as "Dobanol 25" (having 11 to 16 carbon atoms, on average 13.5 carbon atoms).

Examples of functionalized monomers of formula (II) are those having an OH group in the alkyl group, particularly in the omega position of the alkyl group, for example, 2-hydroxyethyl methacrylate and acrylate, 3-hydroxypropylmethacrylate and acrylate, as well as their derivatives singly or doubly methyl-substituted in the 2 position, 4-hydroxybutyl methacrylate and acrylate, but also 2-hydroxypropyl methacrylate and acrylate.

Because of their low aggressiveness in other respects under conditions of use in engine tests, the monomers of formula (II) in which $R_2$ is a polyalkoxylated, and more particularly an ethoxylated, group, for example, 2-(2-ethoxy-ethoxy)ethyl methacrylate and acrylate to methacrylic and acrylic esters of $C_1$–$C_{18}$ fatty alcohol mixtures with average degrees of ethoxylation of from 1 to 60, for example, with an average degree of ethoxylation of 11 or 25, respectively, based on appropriate commercial products, merit special attention. Examples are the acrylic and methacrylic esters of "Carbowax 550", "Marlipal 1618/11", "Marlipal 1618/25", "Carbowax 2000" and "Carbowax 750".

The functionalized monomers of formula (IIA) where $R_7$ represents an alkylene dialkylamino group, and in particular 2-dimethylamino and 2-diethylamino ethyl methacrylate and acrylate, 3-dimethylaminopropyl methacrylate and acrylate, and the corresponding diethylamino compounds, as well as the corresponding amides, and particularly N-(dimethylaminopropyl) methacrylamide are also suitable. These comonomers may be incorporated in the polymer chain by copolymerization with compounds of the formula (II), for example, or later. Formula (IIA) further includes heterocyclically substituted monomers such as 2-(1-imidazolyl)ethyl methacrylate and acrylate, 2-(4-morpholinyl)ethyl methacrylate and acrylate, and 1-(2-methylacryloyloxyethyl)-2-pyrrolidone, as well as the corresponding amides. Special importance attaches also to the monomers of formula (IIB), and particularly to N-vinyl-2-pyrrolidone.

THE OLEFIN COPOLYMERS (OCP)

The olefin copolymers to be used in accordance with the invention are known per se. They are mainly polymers of ethylene, propylene, butylene, and/or other alpha-olefins having from 5 to 20 carbon atoms, as already suggested for use as VI improvers. Their weight-average molecular weight generally ranges from 10,000 to 300,000, and preferably from 50,000 to 150,000. Such olefin copolymers have been described in published German patent applications 16 44 941, 17 69 834, 19 39 037, 19 63 039, and 20 59 981. When the base polymer is a hydrogenated polyisoprene or a copolymer with styrene, commercial hydrogenated products such as "Shellvis 50", "Shellvis 200", or "Shellvis 250" are preferred. Highly suitable for use are ethylene-propylene copolymers. Terpolymers with known third monomers, such as ethylidene-norbornene (see Macromolecular Reviews, vol. 10 [1975]), are also suitable, but allowance must be made for their tendency to crosslink as they age. The distribution may be largely random; however, sequence polymers having ethylene blocks may also be used to advantage. The ratio of the monomers ethylene:propylene is variable within certain limits, the upper limit being about 75 percent for ethylene and about 80 percent for propylene. Because it has less tendency to dissolve in oil, polypropylene is not as suitable as are ethylene-propylene copolymers are.

THE POLYMERIZATION METHOD

The solvent or vehicle used is appropriately an inert solvent having a boiling point of at least 300° C. at 760 mm, preferably a petroleum oil, that is compatible with the use to which it is to be put. Suitable solvents thus are hydrocarbons such as kerosene (boiling range 180°–210° C.), naphthenic oils, paraffinic oils, and gas oils. (See *Ullmanns Enzyklopadie der technischen Chemie,* 4th ed., vol. 10, pp. 641–714.)

In the preparation of concentrated polymer emulsions, vehicles which dissolve olefin copolymers only to a limited extent or are merely swelling agents, as described in detail in U.S. Pat. Nos. 4,677,151 and 4,622,358 are advantageously used. These are, in particular, phthalic esters such as dibutyl phthalate and esters of 2,2,4-trimethyladipic acid with an octanol/decanol mixture, for example. Also suitable are the mono- or polyfunctional alcohols themselves, for example hexadecanol, octadecanol, diethylene glycol, tetraethylene glycol, and methoxypolyethylene glycols with degrees of ethoxylation of about 2 to 50.

The polymerization of the alkyl acrylates and methacrylates is generally carried out as a gradual monomer addition process at from 80° C. to 100° C. in a liquid vehicle with the addition of peroxidic initiators such as tert-butyl peroctoate. When concentrated polymer emulsions are produced, this is done in the presence of a small amount of dissolved olefin copolymer. Polymerization is usually completed after approximately 8 hours. Further monomers can then be graft polymerized onto the polymer at for example 130° C. with the addition of tert-butyl perbenzoate. The desired final composition is then obtained by the addition of further olefin copolymer and optionally solvent or vehicle.

THE ADDITIVES

The VI-improving additives with dispersant and detergent action according to the invention are usually available as relatively concentrated solutions of polymer in one of the aforementioned vehicles. The polymer content of the concentrates generally ranges from 30 to 75, and preferably from 40 to 70, percent by weight.

These additives are advantageously added to the oils or fractions whose viscosity index is to be improved in such amounts that the oils or fractions preferably contain from 1 to 10 percent by weight of the polymeric additives of the present invention.

The advantage offered by the inventive additives is that they exhibit outstanding dispersant and detergent action in gasoline and diesel engines while being completely neutral with respect to gasketing and sealing materials such as "Viton", for example.

A better understanding of the present invention and of its many advantages will be had by referring to the following specific Example, given by way of illustration. The following comments pertain generally to these Examples.

TEST METHODS

The tests were run in conformity with:

1. CCMC European Oil Sequence for Service—Fill Oils for Gasoline Engines, Classes G4 and G5: Low-Temperature Sludge in conformity with ASTM 315 H, Part III, Seq. VE. Black Sludge M 102 E: In conformity with CEC L-41-T-88.
2. CCMC European Oil Sequence for Service—Fill Oils for Diesel Engines, Classes D4, D5 and PD2: Ring Sticking and Piston Cleanliness VW 1,6 TC Diesel in conformity with CEC L-35-T-84.
3. Screening Test for Bore Polishing and Piston Cleanliness for Diesel Engines: MWM B in conformity with CEC-L-12-A-76.
4. VW Elastomer Test TL-VW 521 of 10/7/1988, FKM-E-281.
5. Viscosity measured according to DIN 51562 (Ubbelohde viscosimeter).

KEY TO ABBREVIATIONS

SSI = Shear Stability Index: Loss of thickening action in percent during the shear stability test in conformity with DIN 51,382.

DI Package A = A commercial DI package of API performance level SF/CC.

DI Package B = A commercial DI package of API performance level SF/CD.

EXAMPLES

(A) Preparation of polyalkyl acrylates or methacrylates having additive action

Additive 1

The following mixture is introduced as initial charge into a two-liter four-necked round-bottomed flask equipped with stirrer, thermometer, reflux condenser and metering line:

400.00 g of petroleum oil (intrinsic viscosity/100° C. = 3.9 $mm^2/s$);
4.44 g of 2-hydroxyethyl methacrylate;
39.96 g of the methacrylic ester of a $C_{12}$–$C_{18}$ alcohol mixture;
0.35 g of dodecyl mercaptan; and
1.00 g of tert-butyl peroctoate.

After the components have dissolved, the following mixture is metered in at a constant rate over a period of 3.5 hours at 90° C.:

55.56 g of 2-hydroxyethyl methacrylate;
500.04 g of the methacrylic ester of a $C_{12}$–$C_{18}$ alcohol mixture;
4.44 g of dodecyl mercaptan; and
1.67 g of tert-butyl peroctoate.

Two hours after the completion of this addition, another 1.2 g of tert-butyl peroctoate are fed in. Total polymerization time is 8 hours. A clear, viscous solution is obtained.

Polymer content: 60 wt. %.
Viscosity (100° C., 60 wt. %): 1300 $mm^2/s$.
Viscosity (100° C, 6 wt. in petroleum oil having an intrinsic viscosity at 100° C. of 5.4 $mm^2/s$): 9.7 $mm^2/s$.
SSI (6 wt. % in petroleum oil having an intrinsic viscosity at 100° C. of 6.4 $mm^2/s$): 3.6.

Additive 2

Equipment and procedure as in Example 1.
Initial charge:
400.0 g of petroleum oil (intrinsic viscosity/100° C. = 3.9 $mm^2/s$);
5.73 g of the methacrylic ester of an ethoxylated $C_{16}$–$C_{18}$ fatty alcohol mixture; average degree of ethoxylation = 25;
3.86 g of methyl methacrylate;
34.81 g of the methacrylic ester of a $C_{12}$–$C_{15}$ alcohol mixture;
0.35 g of dodecyl mercaptan; and
1.00 g of tert-butyl peroctoate.
Gradual addition:
71.67 g of the methacrylic ester of an ethoxylated $C_{16}$–$C_{18}$ fatty alcohol mixture; average degree of ethoxylation = 25 ;
48.33 g of methyl methacrylate;
435.60 g of the methacrylic ester of a $C_{12}$–$C_{15}$ alcohol mixture;
4.44 g of dodecyl mercaptan; and
1.67 g of tert-butyl peroctoate.

Two hours after completion of this addition, another 1.2 g of tert-butyl peroctoate are fed in. Total polymerization time is 8 hours. A clear, viscous solution is obtained.

Polymer content: 60 wt. %.
Viscosity (100° C., 60 wt. %): 270 $mm^2/s$.
Viscosity (100° C., 6 wt. % in petroleum oil having an intrinsic viscosity at 100° C. of 5.4 $mm^2/s$): 9.7 $mm^2/s$.
SSI (6 wt.% in petroleum oil having an intrinsic viscosity at 100° C. of 5.4 $mm^2/s$): 3.6.

Additive 3

Equipment and procedure as in Example 1.
Initial charge:
360.0 g of petroleum oil (intrinsic viscosity/100° C. = 5.4 $mm^2/s$);
42.0 g of an ethylene-propylene copolymer (50 wt. % ethylene; SSI [1% in petroleum oil having an intrinsic viscosity/100° C. = 5.4 $mm^2/s$] = 24);
5.5 g of the methacrylic ester of an ethoxylated $C_{16}$–$C_{18}$ fatty alcohol mixture; average degree of ethoxylation = 25;
2.5 g of methyl methacrylate;
36.7 g of the methacrylic ester of a $C_{12}$–$C_{15}$ alcohol mixture;
0.05 g of terpinolene; and
0.61 g of tert-butyl peroctoate.
Gradual addition:
92.7 g of the methacrylic ester of an ethoxylated $C_{16}$–$C_{18}$ fatty alcohol mixture; average degree of ethoxylation = 25;
42.2 g of methyl methacrylate;
618.6 g of the methacrylic ester of a $C_{12}C_{15}$ alcohol mixture;
0.75 g of terpinolene; and
3.39 g of tert-butyl peroctoate.

Two hours after completion of this addition, another 1.6 g of tert-butyl peroctoate are fed in. Total polymerization time is 8 hours. A slightly cloudy, viscous solution is obtained.

This solution is introduced into a four-liter three-necked flask equipped with stirrer, thermometer, and reflux condenser and heated to 100° C.

Addition:
384.5 g of an ethylene-propylene copolymer (50 wt. % ethylene; SSI [1% in petroleum oil having an intrinsic viscosity/100° C. of 5.4 $mm^2/s$] = 24); and
1476.7 g of petroleum oil (intrinsic viscosity/100° C. = 5.4 $mm^2/s$).

After the components have dissolved over a period of 8 hours at 100° C., a cloudy, viscous emulsion is obtained.

Polymer content: 40 wt. %.

Viscosity (100° C., 40 wt. %): 2800 $mm^2/s$.

Viscosity (100° C., 3 wt. % in petroleum oil having an intrinsic viscosity at 100° C. of 5.4 $mm^2/s$): 14.1 $mm^2/s$.

SSI (3 wt. % in petroleum oil having an intrinsic viscosity at 100° C. of 5.4 $mm^2/s$): 24.

Additive 4

Equipment and procedure as in Example 1.

Initial charge:

360.0 g of petroleum oil (intrinsic viscosity/100° C. = 5.4 $mm^2/s$);

42.0 g of an ethylene-propylene copolymer (50 wt. % ethylene; SSI [1% in petroleum oil having an intrinsic viscosity/100° C. of 5.4 $mm^2/s$]: 24);

2.24 g of 2-hydroxyethyl methacrylate;

42.46 g of the methacrylic ester of a $C_{12}$–$C_{18}$ alcohol mixture;

0.05 g of terpinolene; and 2.10 g of tert-butyl peroctoate.

Gradual addition:

37.7 g of 2-hydroxyethyl methacrylate;

715.8 g of the methacrylic ester of a $C_{12}$–$C_{18}$ alcohol mixture;

0.75 g of terpinolene; and 3.39 g of tert-butyl peroctoate.

Two hours after completion of this addition, another 1.6 g of tert-butyl peroctoate are fed in. Total polymerization time is 8 hours. A slightly cloudy, highly viscous solution is obtained.

This solution is introduced into a four-liter three-necked flask equipped with stirrer, thermometer and reflux condenser and heated to 100° C.

Further addition:

384.5 g of an ethylene-propylene copolymer (50 wt. % ethylene; SSI [1% in petroleum oil having an intrinsic viscosity/100° C. of 5.4 $mm^2/s$]: 24); and 1476.7 g of petroleum oil (intrinsic viscosity/100° C. = 5.4 $mm^2/s$).

After the components have dissolved over a period of 8 hours at 100° C., a cloudy, viscous emulsion is obtained.

Polymer content: 40 wt. %.

Viscosity (100° C., 40 wt. %): 2800 $mm^2/s$.

Viscosity (100° C., 3 wt. % in petroleum oil having an intrinsic viscosity at 100° C. of 5.4 $mm^2/s$): 14.1 $mm^2/s$.

SSI (3 wt. % in petroleum oil having an intrinsic viscosity at 100° C. of 5.4 $mm^2/s$): 24.

Additive 5

Equipment and procedure as in Example 1.

Initial charge:

360.0 g of petroleum oil (intrinsic viscosity/100° C. = 5.4 $mm^2/s$;

42.0 g of an ethylene-propylene copolymer (50 wt. % ethylene; SSI [1% in petroleum oil having an intrinsic viscosity/100° C. of 5.4 $mm^2/s$]: 24);

0.22 g of 2-dimethylaminoethyl methacrylate;

2.60 g of methyl methacrylate;

41.88 g of the methacrylic ester of a $C_{12}$–$C_{18}$ alcohol mixture;

0.05 g of terpinolene; and 2.40 g of tert-butyl peroctoate.

Gradual addition:

3.77 g of 2-dimethylaminoethyl methacrylate;

43.70 g of methyl methacrylate;

706.03 g of the methacrylic ester of a $C_{12}$–$C_{18}$ alcohol mixture, 0.75 g of terpinolene; and 7.50 g of tert-butyl peroctoate.

Two hours after completion of this addition, another 1.6 g of tert-butyl peroctoate are fed in. Total polymerization time is 8 hours.

Further addition:

26.0 g of N-vinyl-2-pyrrolidone and 11.0 g of petroleum oil (intrinsic viscosity/100° C. = 5.4 $mm^2/s$).

The batch is then heated to 130° C. After this temperature has been reached, 1.95 g of tert-butyl peroctoate are added, and one and two hours later another 0.95 g of tert-butyl peroctoate is added each time. Total grafting time is 6 hours. A slightly cloudy, viscous solution is obtained. This solution is introduced into a one-liter three-necked flask equipped with stirrer, thermometer, and reflux condenser and heated to 100° C.

Further addition:

384.5 g of an ethylene-propylene copolymer (50 wt. % ethylene; SSI [1% in petroleum oil having an intrinsic viscosity/100° C. of 5.4 $mm^2/s$]24) and 1476.7 g of petroleum oil (intrinsic viscosity/100° C. = 5.4 $mm^2/s$).

After the components have dissolved over a period of 8 hours at 100° C., a cloudy, viscous emulsion is obtained.

Polymer content: 40 wt. %.

Viscosity (100° C., 40 wt. %): 2800 $mm^2/s$.

Viscosity (100° C., 3 wt. % in petroleum oil having an intrinsic viscosity at 100° C. of 5.4 $mm^2/s$): 14.1 $mm^2/s$.

SSI (3 wt. % in petroleum oil having an intrinsic viscosity at 100° C. of 5.4 $mm^2/s$): 24.

Additive 6

Equipment and procedure as in Example 1.

Initial charge:

7.0 g of petroleum oil (intrinsic viscosity/100° C. = 5.4 $mm^2/s$);

9.15 g of an ethylene-propylene copolymer (50 wt. % ethylene; SSI [1% in petroleum oil having an intrinsic viscosity/100° C. of 5.4 $mm^2/s$]24);

2.87 g of methyl methacrylate;

46.70 g of the methacrylic ester of a $C_{12}$–$C_{18}$ alcohol mixture; and 3.0 g of tert-butyl peroctoate.

Gradual addition:

29.25 g of methyl methacrylate;

475.13 g of the methacrylic ester of a $C_{12}$–$C_{18}$ alcohol mixture; and 5.00 g of tert-butyl peroctoate.

Two hours after completion of this addition, another 1.1 g of tert-butyl peroctoate are fed in. Total polymerization time is 8 hours.

Further addition:

18.03 g of N-vinyl-2-pyrrolidone and 12.90 g of petroleum oil (intrinsic viscosity/100° C. = 5.4 $mm^2/s$).

The batch is then heated to 130° C. After this temperature has been reached, 1.5 g of tert-butyl peroctoate are added, and one and two hours later another 0.72 g of tert-butyl peroctoate is added each time. Total grafting time is 6 hours. A slightly cloudy, viscous solution is obtained. This solution is introduced into a four-liter three-necked flask equipped with stirrer, thermometer, and reflux condenser and heated to 100° C.

Further addition:

266.88 g of an ethylene-propylene copolymer (50 wt. % ethylene; SSI [1% in petroleum oil having an intrinsic viscosity/100° C. of 5.4 $mm^2/s$]24) and 857.90 g of petroleum oil (intrinsic viscosity/100° C.=5.4 $mm^2/s$).

After the components have dissolved over a period of 8 hours at 100° C., a cloudy, viscous emulsion is obtained.

Polymer content: 40 wt. %.

Viscosity (100° C., 40 wt. %): 2800 $mm^2/s$.

Viscosity (100° C., 3 wt. % in petroleum oil having an intrinsic viscosity at 100° C. of 5.4 $mm^2/s$): 14.1 $mm^2/s$.

SSI (3 wt. % in petroleum oil having an intrinsic viscosity at 100° C. of 5,4 $mm^2/s$): 24.

Additive 7

Equipment and procedure as in Example 1.

Initial charge:

400.00 g of petroleum oil (intrinsic viscosity/100° C.=3.9 $mm^2/s$);

1.55 g of N-dimethylaminopropyl methacrylamide;

4.44 g of methyl methacrylate;

38.45 g of the methacrylic ester of a $C_{12}$–$C_{18}$ alcohol mixture;

0.35 g of dodecyl mercaptan; and 1.00 g of tert-butyl peroctoate.

Gradual addition:

19.44 g of N-dimethylaminopropyl methacrylamide;

55.56 g of methyl methacrylate;

480.56 g of the methacrylic ester of a $C_{12}$–$C_{18}$ alcohol mixture;

4.44 g of dodecyl mercaptan; and 1.67 g of tert-butyl peroctoate.

Two hours after completion of this addition, another 1.2 g of tert-butyl peroctoate are fed in. Total polymerization time is 8 hours. A clear, viscous solution is obtained.

Polymer content: 60 wt. %.

Viscosity (100° C., 60 wt. %): 500 $mm^2/s$.

Viscosity (100° C., 6 wt. % in petroleum oil having an intrinsic viscosity at 100° C. of 5.4 $mm^2/s$): 9.8 $mm^2/s$.

SSI (6 wt. % in petroleum oil having an intrinsic viscosity at 100° C. of 5.4 $mm^2/s$): 3.6.

Additive 8

Equipment and procedure as in Example 1.

Initial charge:

400.0 g of petroleum oil (intrinsic viscosity/100° C.=3.9 $mm^2/s$);

2.0 g of N-vinyl-2-pyrrolidone;

4.44 g of methyl methacrylate;

38.00 g of the methacrylic ester of a $C_{12}$–$C_{18}$ alcohol mixture;

0.35 g of dodecyl mercaptan; and 1.00 g of tert-butyl peroctoate.

Gradual addition:

25.00 g of N-vinyl-2-pyrrolidone;

55.56 g of methyl methacrylate;

475.00 g of the methacrylic ester of a $C_{12}$–$C_{18}$ alcohol mixture;

4.44 g of dodecyl mercaptan; and 1.67 g of tert-butyl peroctoate.

Two hours after completion of this addition, another 1.2 g of tert-butyl peroctoate are fed in. Total polymerization time is 8 hours. A clear, viscous solution is obtained.

Polymer content: 60 wt. %.

Viscosity (100° C., 60 wt. %): 980 $mm^2/s$.

Viscosity (100° C., 6 wt. % in petroleum oil having an intrinsic viscosity at 100° C. of 5.4 $mm^2/s$): 9.8 $mm^2/s$.

SSI (6 wt. % in petroleum oil having an intrinsic viscosity at 100° C. of 5.4 $mm^2/s$): 3.6.

(B) UTILIZATION OF POLYALKYL ACRYLATES OR METHACRYLATES AS ADDITIVES

EXAMPLE 1

In a 20 liter tank equipped with a heating system, an agitator, and a thermometer, the following components are mixed at 65° C. to give a 10W-30 multigrade oil:

331.5 g of Additive 1;

975.0 g of an ethylene-propylene copolymer (50 wt. % ethylene; SS [1% in petroleum oil having an intrinsic viscosity/100° C. of 5.4 $mm^2/s$]: 24), in the form of an 11 wt. % solution in petroleum oil (intrinsic viscosity/100° C. of 5.4 $mm^2/s$);

1280.0 g of DI Package A;

1300.0 g of poly-alpha-olefin (intrinsic viscosity/100° C.=4 $mm^2/s$);

4550.0 g of petroleum oil (intrinsic viscosity/100° C.=3.9 $mm^2/s$); and 4563.0 g of petroleum oil (intrinsic viscosity/100° C.=6.2 $mm^2/s$).

Example 2

Equipment and procedure as in Example 1. The following components are mixed to give a 10W-30 multigrade oil:

331.5 g of Additive 2;

975.0 g of ethylene-propylene copolymer (50 wt. % ethylene; SSI (1% in petroleum oil having an intrinsic viscosity/100° C. of 5.4 $mm^2/s$]: 24), in the form of an 11 wt. % solution in petroleum oil (intrinsic viscosity/100° C.=5.4 $mm^2/s$);

1280.5 g of DI Package A;

1399.9 g of poly-alpha-olefin (intrinsic viscosity/100° C., 4 $mm^2/s$);

4550.0 g of petroleum oil (intrinsic viscosity/100° C., 3.9 $mm^2/s$); and 4563.0 g of petroleum oil (intrinsic viscosity/100° C., 6.2 $mm^2/s$).

Example 3

Equipment and procedure as in Example 1. The following components are mixed to give a 10W-30 multigrade oil:

762.8 g of Additive 3;

1280.5 g of DI Package A;

1300.0 g of poly-alpha-olefin (intrinsic viscosity/100° C.=4 $mm^2/s$);

407.2 g of petroleum oil (intrinsic viscosity/100° C.=5.4 $mm^2/s$);

4550.0 g of petroleum oil (intrinsic viscosity/100° C.=3.9 $mm^2/s$); and 4699.5 g of petroleum oil (intrinsic viscosity/100° C.=6.2 $mm^2/s$).

Example 4

Equipment and procedure as in Example 1. The following components are mixed to give a 10W-30 multigrade oil:

762.8 g of Additive 5;
1280.5 g of DI Package A;
1300.0 g of poly-alpha-olefin (intrinsic viscosity/100° C.=4 $mm^2/s$);
407.2 g of petroleum oil (intrinsic viscosity/100° C., 5.4 $mm^2/s$);
4550.0 g of petroleum oil (intrinsic viscosity/100° C., 3.9 $mm^2/s$); and
4699.5 g of petroleum oil (intrinsic viscosity/100° C., 6.2 $mm^2/s$).

Example 5

Equipment and procedure as in Example 1. The following components are mixed to give a 10W-30 multigrade oil:

688.5 g of Additive 4;
1447.5 g of DI Package A;
5250.0 g of petroleum oil (intrinsic viscosity/100° C.=10.5 $mm^2/s$); and
7584.0 g of petroleum oil (intrinsic viscosity/100° C.=5.4 $mm^2/s$).

Example 6

Equipment and procedure as in Example 1. The following components are mixed to give a 15W-40 multigrade oil:

688.5 g of Additive 5;
1,477.5 g of DI Package A;
5250.0 g of petroleum oil (intrinsic viscosity/100° C.=10.5 $mm^2/s$); and
7584.0 g of petroleum oil (intrinsic viscosity/100° C., 5.4 $mm^2/s$).

Example 7

Equipment and procedure as in Example 1. The following components are mixed to give a 15W-30 multigrade oil:

130.0 g of Additive 2;
539.5 g of DI Package B;
975.0 g of petroleum oil (intrinsic viscosity/100° C.=10.5 $mm^2/s$); and
4855.5 g of petroleum oil (intrinsic viscosity/100° C., 5.4 $mm^2/s$).

Example 8

Equipment and procedure as in Example 1. The following components are mixed to give a 15W-30 multigrade oil:

130.0 g of Additive 1;
539.5 g of DI Package B;
975.0 g of petroleum oil (intrinsic viscosity/100° C.=10.5 $mm^2/s$); and
4,855.5 g of petroleum oil (intrinsic viscosity/100° C., 5.4 $mm^2/s$).

Comparative Example 1

Equipment and procedure as in Example 1. The following components are mixed to give a 10W-30 multigrade oil:

762.8 g of Additive 6;
1,280.5 g of DI Package A;
467.2 g of petroleum oil (intrinsic viscosity/100° C.=5.4 $mm^2/s$);
1300.0 g of poly-alpha-olefin (intrinsic viscosity/100° C.=4 $mm^2/s$);
4550.0 g of petroleum oil (intrinsic viscosity/100° C. 3.9 $mm^2/s$); and
4639.5 g of petroleum oil (intrinsic viscosity/100° C.=6.2 $mm^2/s$).

Comparative Example 2

Equipment and procedure as in Example 1. The following components are mixed to give a 15W-30 multigrade oil:

130.0 g of Additive 7;
539.5 g of DI Package B;
975.0 g of petroleum oil (intrinsic viscosity/100° C.=10.5 $mm^2/s$); and
4855.5 g of petroleum oil (intrinsic viscosity/100° C.=5.4 $mm^2/s$).

Comparative Example 3

Equipment and procedure as in Example 1. The following components are mixed to give a 15W-30 multigrade oil:

130.0 g of Additive 8;
539.5 g of DI Package B;
975.0 g of petroleum oil (intrinsic viscosity/100° C.=10.5 $mm^2/s$); and
4855.5 g of petroleum oil (intrinsic viscosity/100° C.=5.4 $mm^2/s$).

TABLE 1

| Sequence VE Test Results (ASTM 315 H Part III) merit rating[1)] | | | | | | | |
|---|---|---|---|---|---|---|---|
| Example | Additive | AS | RCS | PSV | AV | CW[2)] max. | CW avge. |
| Limits | | 9.0 | 7.0 | 6.7 | 5.0 | 15.5 | 4.0 |
| 1 | 1 | 9.19 | 7.98 | 7.14 | 5.81 | 8.90 | 3.30 |
| 2 | 2 | 9.17 | 7.83 | 6.72 | 5.84 | 9.30 | 1.88 |
| 3 | 3 | 9.27 | 8.39 | 6.52 | 5.76 | 7.90 | 2.89 |
| 4 | 5 | 8.52 | 7.63 | 6.78 | 5.85 | 12.50 | 12.50 |
| Comparative Example 1 | 6 | 8.01 | 6.85 | 6.01 | 9.7 | 6.32 | 7.10 |

TABLE 2

| M 102-E Test-Run Results (CEC-L-41-T-88) merit rating[3)] | | | | | | | |
|---|---|---|---|---|---|---|---|
| Example | Additive | Cylinder head | Cylinder-head cover | Oil sump | Oil gallery | Timing-gearcase cover | Average value |
| 5 | 4 | 9.26 | 9.14 | 9.39 | 9.34 | 9.25 | 9.27 |

TABLE 2-continued

| | | M 102-E Test-Run Results (CEC-L-41-T-88) merit rating[3] | | | | | |
|---|---|---|---|---|---|---|---|
| Example | Additive | Cylinder head | Cylinder-head cover | Oil sump | Oil gallery | Timing-gearcase cover | Average value |
| 6 | 5 | 7.33 | 8.45 | 6.31 | 8.42 | 8.13 | 7.72 |

[1]10 = clean
[2]Cam Wear $10^{-3}$ inches
[3]10 = clean
AS = Average Sludge
RCS = Rocker Cover Sludge
PSV = Piston Skirt Varnish
AV = Average Varnish
CW = Cam Wear

TABLE 3

| | | MWMB Test-Run Results (CEC-L-12-A-76) VW Elastomer Test TL-VW-521 of 10/7/1988 FKM-E-281 | | | |
|---|---|---|---|---|---|
| Example | Additive | Piston evaluation (points) merit rating (100 = clean) | Delta ultimate tensile strength % | Delta elongation at break % | Cracks |
| | | Limit | ±20 | ±25 | None |
| 7 | 2 | 65 | −9 | −13 | None |
| 8 | 1 | 68 | −7 | −10 | None |
| Comparative Example 2 | 7 | 63 | −30 | −29 | None |
| Comparative Example 3 | 8 | 63 | −16 | −25 | None |

CONCLUSIONS BASED ON EXAMPLES 1 TO 8

SPECIAL EFFECTS

As is apparent from Table 1, additives having OH groups (Example 1) as well as additives having ether groups (Examples 2 and 3) fare better in the Sequence VE Test so far as sludge and varnish are concerned. The basis for comparison is the prior art, represented by an additive with vinyl pyrrolidone (Comparative Example 1). Example 4 shows that an additive, also in accordance with the invention, which is in the form of a concentrated polymer emulsion and was produced in the presence of a chain-transfer agent, ranks between them in the evaluation.

Table 2 presents the results of the M-102-E test for black sludge. Additive 4 containing OH groups (Example 5) has a significantly higher rating than Additive 5 containing vinyl pyrrolidone (Example 6). Both additives are in the form of a concentrated polymer emulsion.

In Table 3, Additive 2 containing ether groups (Example 7) and Additive 1 containing OH groups (Example 8) are compared with the non-inventive Additives of Comparative Examples 2 and 3 containing dimethylamino groups (Comparative Example 2) and pyrrolidone groups (Comparative Example 3), respectively. While the MWMB engine screening test reveals no pronounced differences so far as the evaluation for carbon deposits on the piston, is concerned, marked differences are brought out by the VW Elastomer Test. Additives 2 and 1 according to the invention perform better, Additive 1 (having OH groups) being even superior to Additive 2 (having ether groups).

What is claimed is:

1. A method for making a concentrated emulsion comprising a polyalkyl acrylate or polyalkyl methacrylate copolymer and an olefin copolymer suitable for improving the viscosity index, in a liquid oil-compatible vehicle for use an oil additive having improved dispersant and detergent effect in diesel and gasoline engines, which method comprises polymerizing, in said oil-compatible liquid vehicle, from 80 to 99.5 parts by weight of (I) at least one member selected from the group consisting of alkyl acrylates and alkyl methacrylates of the formula

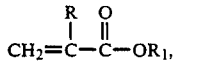

wherein R is hydrogen or methyl and $R_1$ is alkyl having from 6 to 24 carbon atoms, from 0.5 to 20 parts by weight of (II) at least one monomer selected from the group consisting of functionalized alkyl acrylates or methacrylates of the formula

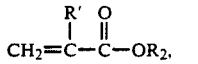

wherein R' is hydrogen or methyl and $R_2$ is alkyl having from 2 to 6 carbon atoms which is substituted with at least one OH group, or is a polyalkoxylated group of the formula

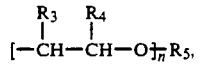

wherein $R_3$ and $R_4$ are hydrogen or methyl, $R_5$ is hydrogen or alkyl having from 1 to 40 carbon atoms, and n is an integer from 1 to 60, from 0 to 20 parts by weight of (III) at least one member selected from the group of alkyl acrylates and alkyl methacrylates of the formula

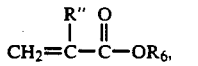

wherein R'' is hydrogen or methyl and $R_6$ is alkyl having from 1 to 5 carbon atoms, and from 0 to 20 parts by weight of at least one member selected from the group of compounds (IIB) having the formula $$CH_2{=}\overset{\overset{\displaystyle H}{|}}{C}{-}Bs,$$

wherein Bs is a five- or six-membered heterocycle, and compounds (IIA) having the formula $$CH_2{=}\overset{\overset{\displaystyle R'''}{|}}{C}{-}\overset{\overset{\displaystyle O}{||}}{C}{-}XR_7,$$

wherein R''' is hydrogen or methyl, X is oxygen or —NH— or —NR'$_6$— where R'$_6$ is alkyl having from 1 to 5 carbon atoms, and $R_7$ is linear or branched alkyl having from 2 to 20 carbon atoms which is substituted with at least one $NR_8$ $R_9$ group, $R_8$ and $R_9$ taken alone being, independently of each other, alkyl having from 1 to 20 carbon atoms, and $R_8$ and $R_9$ taken together forming, together with the nitrogen atom, a five- or six-membered ring, or such a ring containing a further nitrogen or oxygen atom, or such rings substituted with $C_1$–$C_6$ alkyl, in the presence of from 1 to 30 percent, by weight of the total of the monomers and polymers present, of a member selected from the group consisting of olefin copolymers (OCP), hydrogenated isoprene, hydrogenated butadiene-styrene copolymers (HSD), hydrogenated polyisoprene, and hydrogenated polybutadiene.

2. A method as in claim 1 wherein the polymerization is carried out with the addition of from 0.1 to 2.0 percent of a free radical initiator and in the presence of 0.05 to 0.5 percent of a molecular-weight regulators, both percentages being by weight of the total monomers.

3. A method as in claim 1 wherein the total of the monomers and polymers present in the liquid vehicle is from 40 to 75 percent by weight of the emulsion.

4. A method as in claim 1 wherein further olefin copolymer is added to the completely polymerized batch in such an amount that the amount of olefin copolymer present is increased to 31 to 80 percent by weight of the total polymer.

5. A method as in claim 4 wherein said olefin copolymer is added as a 10 to 20 percent solution in said oil-compatible liquid vehicle.

6. A method as in claim 4 wherein said olefin copolymer is added in undiluted form and is then emulsified by shearing action.

7. A method as in claim 1 wherein, after the monomers of formulas (I), (II), (IIA), (IIB), and (III) have been polymerized, a further 0.5 to 15 parts by weight of at least one monomer selected from the group having the formulas (IIA) and (IIB) are added and polymerized.

8. A method as in claim 7 wherein a further 1 to 30 parts by weight of at least one monomer selected from the group having the formulas (I) and (II) are added and polymerized together with the monomer or monomers of formulas (IIA) and (IIB).

9. An emulsion made by the method of claim 7.

10. An emulsion made by the method of claim 8.

11. A method for making a polyalkyl acrylate or polyalkyl methacrylate copolymer, adaptable to use as an oil additive for improving the viscosity index and having an improved dispersant and detergent effect in diesel and gasoline engines, said copolymer comprising (I) from 80 to 99.5 parts by weight of at least one member selected from the group consisting of alkyl acrylates and alkyl methacrylates of the formula $$CH_2{=}\overset{\overset{\displaystyle R}{|}}{C}{-}\overset{\overset{\displaystyle O}{||}}{C}{-}OR_1,$$

wherein R is hydrogen or methyl and $R_1$ is alkyl having from 6 to 24 carbon atoms, (II) from 0.5 to 20 parts by weight of at least one member selected from the group consisting of functionalized alkyl acrylates and methacrylates of the formula $$CH_2{=}\overset{\overset{\displaystyle R'}{|}}{C}{-}\overset{\overset{\displaystyle O}{||}}{C}{-}OR_2,$$

wherein R' is hydrogen or methyl and $R_2$ is a polyalkoxylated group of the formula $$\left[\overset{\overset{\displaystyle R_3}{|}}{C}H{-}\overset{\overset{\displaystyle R_4}{|}}{C}H{-}O\right]_n R_5,$$

wherein $R_3$ and $R_4$ are hydrogen or methyl, $R_5$ is alkyl having from 1 to 40 carbon atoms, and n is an integer from 1 to 60, the sum of the monomers (I) and (II) being 100 parts by weight, (III) from 0 to 20 parts by weight of at least one member selected from the group of alkyl acrylates and alkyl methacrylates of the formula $$CH_2{=}\overset{\overset{\displaystyle R''}{|}}{C}{-}\overset{\overset{\displaystyle O}{||}}{C}{-}OR_6,$$

wherein R'' is hydrogen or methyl and $R_6$ is alkyl having from 1 to 5 carbon atoms, and (IV) from 0 to 20 parts by weight of at least one member selected from the group of compounds (IIB) having the formula $$CH_2{=}\overset{\overset{\displaystyle H}{|}}{C}{-}Bs,$$

wherein Bs is a five- or six-membered heterocycle, and compounds (IIA) having the formula $$CH_2{=}\overset{\overset{\displaystyle R'''}{|}}{C}{-}\overset{\overset{\displaystyle O}{||}}{C}{-}XR_7,$$

wherein R''' is hydrogen or methyl, X is oxygen or —NH— or —NR'$_6$— where R'$_6$ is hydrogen or methyl, and $R_7$ is linear or branched alkyl having from 2 to 20 carbon atoms which is substituted with at least one —$NR_8$—$R_9$ group, $R_8$ and $R_9$ taken alone being, independently of each other, alkyl having from 1 to 20 carbon atoms, and $R_8$ and $R_9$ taken together forming, together with the nitrogen atom, a five- or six-membered ring, or such a ring containing a further nitrogen or oxygen atom, or such rings substituted with $C_1$–$C_6$ alkyl, which method comprises polymerizing monomers (I), (II) and (III) to form a polymer and then adding and polymerizing from 0.5 to 15 parts by weight of at least one monomer selected from the group having the formulas (IIA) and (IIB).

12. A copolymer made according to the method of claim 11.

13. A method as in claim 11 wherein a further 1 to 30 parts by weight of at least one monomer selected form the group having the formulas (I) and (III) are added and polymerized together with the monomer or monomers of formulas (IIA) and (IIB).

14. A copolymer made according to the method of claim 13.

15. A polyalkyl acrylate or polyalkyl methacrylate copolymer, adaptable to use as an oil additive for improving the viscosity index and having an improved dispersant and detergent effect in diesel and gasoline engines, said copolymer consisting essentially of (I) from 80 to 99.5 parts by weight of at least one member selected from the group consisting of alkyl acrylates and alkyl methacrylates of the formula $$CH_2{=}\overset{\overset{R}{|}}{C}{-}\overset{\overset{O}{\|}}{C}{-}OR_1,$$

wherein R is hydrogen or methyl and $R_1$ is alkyl having from 6 to 24 carbon atoms, (II) from 0.5 to 20 parts by weight of at least one member selected from the group consisting of functionalized alkyl acrylates and methacrylates of the formula $$CH_2{=}\overset{\overset{R'}{|}}{C}{-}\overset{\overset{O}{\|}}{C}{-}OR_2,$$

wherein R' is hydrogen or methyl and $R_2$ is a polyalkoxylated group of the formula $$\left[\overset{\overset{R_3}{|}}{C}H{-}\overset{\overset{R_4}{|}}{C}H{-}O\right]_n R_5,$$

wherein $R_3$ and $R_4$ are hydrogen or methyl, $R_5$ or alkyl having from 1 to 40 carbon atoms, and n is an integer from 1 to 60, the sum of the monomers (I) and (II) being 100 parts by weight, and (III) from 0 to 20 parts by weight of at least one member selected form the group of alkyl acrylates and alkyl methacrylates of the formula $$CH_2{=}\overset{\overset{R''}{|}}{C}{-}\overset{\overset{O}{\|}}{C}{-}OR_6,$$

wherein R'' is hydrogen or methyl and $R_6$ is alkyl having from 1 to 5 carbon atoms, said polymer being prepared by a polymerization process during which a monomer composition is added to a polymerization batch over time and wherein the same monomers are always present in the composition added over time.

16. A copolymer as in claim 15 which additionally comprises from 0 to 20 parts by weight of at least one member selected from the group of compounds (IIB) having the formula $$CH_2{=}\overset{\overset{H}{|}}{C}{-}Bs,$$

wherein Bs is a five- or six-membered heterocycle, and compounds (IIA) having the formula $$CH_2{=}\overset{\overset{R'''}{|}}{C}{-}\overset{\overset{O}{\|}}{C}{-}XR_7,$$

wherein R''' is hydrogen or methyl, X is oxygen or —NH— or —$NR'_6$— where $R'_6$ is alkyl having from 1 to 5 carbon atoms, and $R_7$ is linear or branched alkyl having from 2 to 20 carbon atoms which is substituted with at least one $NR_8R_9$ group, $R_8$ and $R_9$ taken alone being, independently of each other, alkyl having from 1 to 20 carbon atoms, and $R_8$ and $R_9$ taken together forming, together with the nitrogen atom, a five- or six-membered ring, or such a ring containing a further nitrogen or oxygen atom, or such rings substituted with $C_1$–$C_6$ alkyl.

17. A concentrated polymer-in-oil emulsion, adaptable to use as an oil additive for improving the viscosity index and having an improved dispersant and detergent effect in diesel and gasoline engines, having a dispersing phase which is an oil-compatible liquid vehicle and a dispersed phase comprising a member selected from the group consisting of olefin copolymers, hydrogenated isoprene, hydrogenated butadiene-styrene copolymers, hydrogenated polyisoprene, and hydrogenated polybutadiene present in combination with a polyalkyl acrylate or polyalkyl methacrylate copolymer comprising (I) from 80 to 99.5 parts by weight of at least one member selected from the group consisting of alkyl acrylates and alkyl methacrylates of the formula $$CH_2{=}\overset{\overset{R}{|}}{C}{-}\overset{\overset{O}{\|}}{C}{-}OR_1,$$

wherein R is hydrogen or methyl and $R_1$ is alkyl having from 6 to 24 carbon atoms, (II) from 0.5 to 20 parts by weight of at least one member selected from the group consisting of functionalized alkyl acrylates and methacrylates of the formula $$CH_2{=}\overset{\overset{R'}{|}}{C}{-}\overset{\overset{O}{\|}}{C}{-}OR_2,$$

wherein R' is hydrogen or methyl and $R_2$ is alkyl having from 2 to 6 carbon atoms which is substituted with at least one OH group, or is a polyalkoxylated group of the formula $$\left[\overset{\overset{R_3}{|}}{C}H{-}\overset{\overset{R_4}{|}}{C}H{-}O\right]_n R_5,$$

wherein $R_3$ and $R_4$ are hydrogen or methyl, $R_5$ is hydrogen or alkyl having from 1 to 40 carbon atoms, and n is an integer from 1 to 60, the sum of the monomers (I) and (II) being 100 parts by weight, and (III) from 0 to 20 parts by weight of at least one member selected form the group of alkyl acrylates and alkyl methacrylates of the formula $$CH_2{=}\overset{\overset{R''}{|}}{C}{-}\overset{\overset{O}{\|}}{C}{-}OR_6,$$

wherein R'' is hydrogen or methyl and $R_6$ is alkyl having from 1 to 5 carbon atoms.

* * * * *

UNITED STATES PATENT AND TRADEMARK OFFICE

CERTIFICATE OF CORRECTION

PATENT NO. : 5,188,770

DATED : February 23, 1993

INVENTOR(S) : Pennewiss, et. al.

It is certified that error appears in the above-indentified patent and that said Letters Patent is hereby corrected as shown below:

Title page, item [75] add the name of an omitted inventor, --Ulrich Schoedel, Rossdorf, Federal Republic of Germany--.

Signed and Sealed this

Seventeenth Day of May, 1994

*Attest:*

*Attesting Officer*

BRUCE LEHMAN

*Commissioner of Patents and Trademarks*